US005154207A

United States Patent [19]

Bolt

[11] Patent Number: 5,154,207

[45] Date of Patent: Oct. 13, 1992

[54] PRESSURE CONTROL VALVE AND TRANSDUCER PACKAGE

[75] Inventor: David J. Bolt, West Alexandria, Ohio

[73] Assignee: Mosier Industries, Inc., Brookville, Ohio

[21] Appl. No.: 739,998

[22] Filed: Aug. 2, 1991

[51] Int. Cl.[5] ..... F15B 13/044

[52] U.S. Cl. ..... 137/625.65; 91/433; 91/459; 137/884

[58] Field of Search ..... 91/433, 459; 137/625.65, 884

[56] References Cited

U.S. PATENT DOCUMENTS

| | | | |
|---|---|---|---|
| 4,106,390 | 8/1978 | Kodaira et al. . | |
| 4,413,648 | 11/1983 | Walters et al. | 137/487.5 X |
| 4,598,626 | 7/1986 | Walters et al. | 91/433 |
| 4,628,499 | 12/1986 | Hammett . | |
| 4,666,374 | 5/1987 | Nelson . | |
| 4,700,610 | 10/1987 | Bauer et al. | 91/433 X |
| 4,712,470 | 12/1987 | Schmitz | 91/433 |
| 4,741,247 | 5/1988 | Glomeau et al. . | |
| 4,763,560 | 8/1988 | Sasaki . | |
| 4,770,200 | 9/1988 | Nesler et al. . | |
| 4,819,543 | 4/1989 | Leinen . | |
| 4,878,417 | 11/1989 | Facon . | |
| 4,932,311 | 6/1990 | Mibu et al. . | |
| 4,970,941 | 11/1990 | Reinhardt | 137/625.65 X |

OTHER PUBLICATIONS

Tran-Sair-A Rodless Cylinder with a Pneumatic Brake-Brochure dated 1987.

*Primary Examiner*—Gerald A. Michalsky
*Attorney, Agent, or Firm*—Biebel & French

[57] ABSTRACT

A pressure control valve and transducer package for use in combination with a pneumatic actuator which incorporates a double acting pneumatic cylinder includes, in a single multi-component unit, a valve assembly constructed for direct coupling into the pneumatic pressure loop for operating the actuator, and a second component which comprises a fixture housing one or more continuously operating sensors for measuring the pressures supplied to the opposite ends of the cylinder in the actuator and transmitting appropriate signals conveying that information to a microprocessor which in turn regulates the supply flow rate of pressure gas to the cylinder through a closed loop feedback system.

7 Claims, 3 Drawing Sheets

PRESSURE CONTROL VALVE AND TRANSDUCER PACKAGE

BACKGROUND OF THE INVENTION

This invention relates to the field of pneumatic actuators, and while not limited thereto, it has particular relation to the apparatus and method for positioning a pneumatic actuator disclosed in a commonly owned application Ser. No. 739,999, filed on even date herewith, Aug. 2, 1991.

The apparatus disclosed in that application includes an actuator wherein a movable member in the form of a piston is connected into a pneumatic pressure loop and caused to move linearly back and forth in response to the difference between the pressures applied to the opposite ends thereof. The operation of that apparatus includes regulation of the supply rate of pressure gas to the movable member through a closed loop feedback system which includes a microprocessor. It has been found in the development of that system that it is most advantageous that the path of the pressure gas in the pressure loop be as short as possible, and also that the pressure therein be sensed at a location or locations as close as possible to the valve controlling the pressure flow.

SUMMARY OF THE INVENTION

The present invention was developed to satisfy the conditions outlined in the preceding sentence by providing a pressure control valve and transducer package of relatively simple mechanical construction which can be readily connected, in the most advantageous position, into a closed pressure loop for positioning a pneumatic actuator, and specifically in a position as close as possible to both the pressure control valve and the piston to which the operating pressures are applied.

To accomplish this objective, the invention provides a package which includes, in a single multicomponent unit, a valve assembly constructed for direct coupling into the pneumatic pressure loop for operating a pneumatic actuator to control differentially the flow of pneumatic gas to and from the opposite ends of the actuator, and a second component which comprises a fixture housing a continuously operating sensor for measuring the differential pressure supplied to the actuator and transmitting appropriate signals conveying that information to the microprocessor.

The invention thus offers the operating advantage of reducing to a minimum both the path of pressure gas between the valve and the pneumatic actuator and the path of pressure gas from the valve to the sensor which measures the differential pressure being applied to the actuator. The invention also offers the practical advantage that in its preferred embodiment, the package includes a valve unit and a pressure transducer unit which can be mechanically separated from each other if only one of thereof requires replacement in the field.

Additional objects and advantages of the invention will be apparent from or pointed out in connection with the detailed description which follows.

DESCRIPTION OF THE PREFERRED EMBODIMENT

Figure 1:
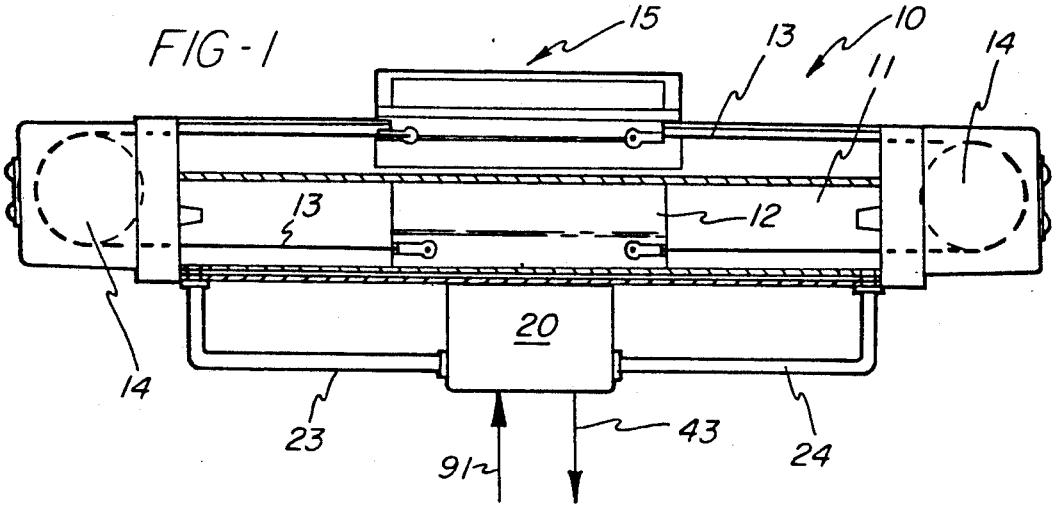
FIG. 1 is a diagram illustrating the position of the valve and transducer package of the invention in the pressure loop of a pneumatic actuator.

FIG. 1 shows somewhat diagrammatically a pneumatic actuator 10 such as a pneumatically operated rodless cylinder sold under the trade name TRANSAIR by the assignee of this application, Mosier Industries, Inc., Brookville, Ohio. This actuator 10 comprises a cylinder 11 in which a piston 12 is caused to move back and forth linearly in response to the pressure differential applied to opposite ends of the cylinder 11. At each end of the actuator, a high tensile steel band 13 wraps a pulley 14 and has its opposite ends attached respectively to the adjacent ends of the piston 12 and of a carriage assembly 15 mounted for back and forth linear movement along the top of the actuator 10. Thus whenever the piston 12 moves within cylinder 11, it will cause the same movement of the carriage 15 in the opposite direction.

The pneumatic pressure loop in FIG. 1 includes a pressure control valve and transducer package 20 which operates under the control of a microprocessor 21 to regulate the flow of pneumatic gas ("air") from a main supply source 22 through lines 23 and 24 to the opposite ends of the cylinder 11, to measure the pressure differential between the two ends of the cylinder 11, and to transmit appropriate signals of that information back to the microprocessor 21.

The package 20 comprises two primary components, the valve assembly indicated generally at 25 and a pressure transducer assembly 26 which is mounted on one side of the valve assembly 25. As illustrated in the exploded view in FIG. 3, the mechanical components of the valve assembly include a valve body 30 wherein a valve member 31, shown diagrammatically in FIG. 2 as a valve spool, operates between limit positions as described hereinafter under the control of a proportional torque motor 33 mounted on top of the valve body 30 and having a cover 34 bolted to the valve body. The other component of the valve assembly is a valve base 35 on which the valve body 30 is mounted and secured by bolts 36.

Figure 2:
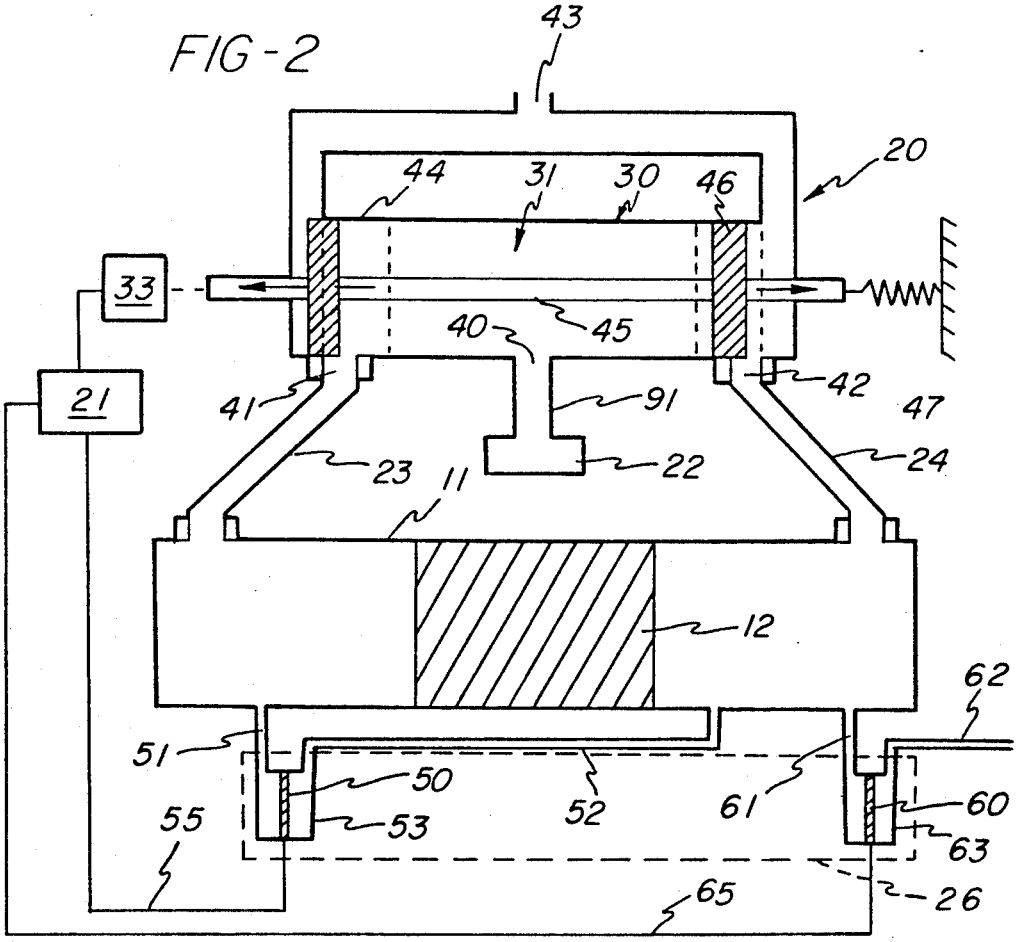
FIG. 2 is a diagrammatic view illustrating the functional characteristics of a valve and transducer package in accordance with the invention.
Figure 3:
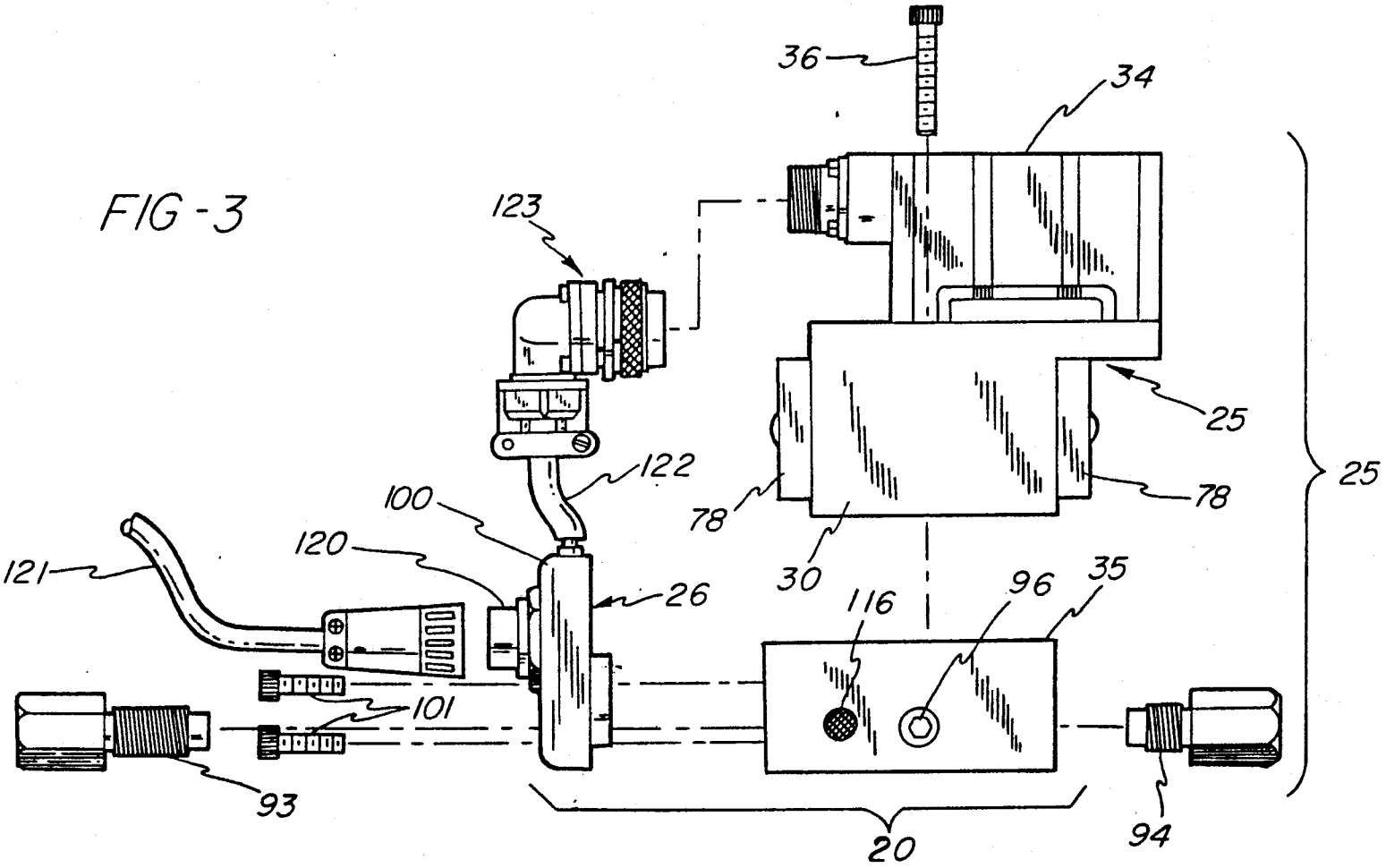
FIG. 3 is an exploded elevational view of the component elements of a valve and transducer package in accordance with the invention.

FIG. 2 illustrates diagrammatically the functional characteristics required for the purposes of the invention in the valve assembly 25 and transducer assembly 26. It is to be understood that there are many commercially available valve assemblies which possess these characteristics, and the valve assembly shown in FIG. 3 is a commercially available four-way proportional valve sold as Model 10-1100 Servo Valve by Dynamic Valves, Inc., Palo Alto, Calif.

For the purposes of the present invention, it is necessary only that the valve body 30 be provided with a pressure supply port 40, two pressure outlet ports 41 and 42, and an exhaust port 43 leading to the atmosphere. The essential functional requirement is that the valve member 31 be movable from one limit position, wherein it connects one of the ports 41 and 42 with the port 40 while connecting the other of ports 41 and 42 with exhaust port 43 to another limit position wherein these conditions are reversed so that the ports 40 and 42 are connected while the ports 41 and 43 are connected. This is illustrated in FIG. 2 by showing the valve member 31 as a rod 45 which has thereon a pair of spaced spool members 44 and 46, and which is moved lengthwise in opposite directions by the torque motor 33 and an opposed spring 47.

In the positions of the parts shown in FIG. 2, the spool member 44 is in partially opening relation with the pressure outlet port 41 so that pressure air is being supplied through the line 23 to the left-hand end of cylinder 11. The spool member 46 is in a position partially connecting the exhaust port 43 with the outlet port 42 which is in turn connected by the line 24 with the right-hand end of cylinder 11, thereby providing for throttled escape of pressure air from that end of cylinder 11. There will therefore be a differential pressure applied to the left-hand end of piston 12 causing it to move to the right.

To complete the description of the operation of these parts, in one limit position of the valve member 31, the spool member 44 would be as far to the left as it can move, namely to a position wherein it fully opens the outlet pressure port 23 to line 40 while the spool member 46 will similarly fully open the port 42 and thereby connect the line 24 with exhaust port 43. The other limit position of valve member 31 would be as far to the right as it can move in FIG. 2, and in that position the spool member 44 would connect the port 41 directly with the exhaust port 43, while the port 42 would be fully open to receive pressure air from port 40 for passage through line 24 to the right-hand end of cylinder 11. The positions of these parts shown in FIG. 2 constitute simply one example of the many intermediate positions between the limit positions.

The transducer component 26 of the package 20 of the invention is also illustrated diagrammatically in FIG. 2. It includes a differential pressure sensor 50 mounted within transducer assembly 26 and provided with gas pressure connections inside the valve base 35 with the pressure outlet ports 41 and 42. For convenience of diagrammatic illustration, however, these connections are shown in FIG. 2 at 51 and 52 as directly with the opposite ends of the cylinder 11.

The pressure sensor 50 may be a readily available solid state bridge-type strain gauge sensor such as a Model 1410 pressure sensor sold by IC Sensors of Milpials, Calif. It is mounted in a case 53 wherein spaces are provided on each side of sensor 50 which communicate through the pressure connections 51 and 52 with the opposite ends of cylinder 11 respectively, and the direction and extent of the resulting bending of sensor 50 in response to changes in the pressure effective on its exposed surfaces is converted into a signal transmitted by a line 55 back to the microprocessor 21.

For the purposes of the present invention, only one pressure sensor unit is needed in order to measure the differential pressure across the piston 12. However, FIG. 2 shows a second such assembly comprising a strain gauge sensor 60 mounted in a case 63 which is provided with a pressure connection 61 with one end of cylinder 11 and a connection 62 to atmosphere, as described hereinafter. The sensor 60 therefore measures only the gauge pressure in one end of cylinder 11, and this measurement is converted into a signal transmitted by a line 65 to the microprocessor 21 for use thereby as described in the above-noted application Ser. No. 739,999.

That application also describes in detail the operation of the complete control system of which the parts shown in FIG. 2 constitute a portion. In general terms, the microprocessor 21 generates a signal to the torque motor 33 which causes the valve member 31 to be moved to the position which will create differential pressure conditions in cylinder 11 corresponding to a value that has also been calculated by the microprocessor 21. The resulting pressure conditions are in turn measured by the sensor 50, and an appropriate signal is transmitted on line 55 back to the microprocessor 21 for comparison with the previously calculated value so that any necessary modulation or other correction can then be effected under the control of the microprocessor 21.

Figure 4:
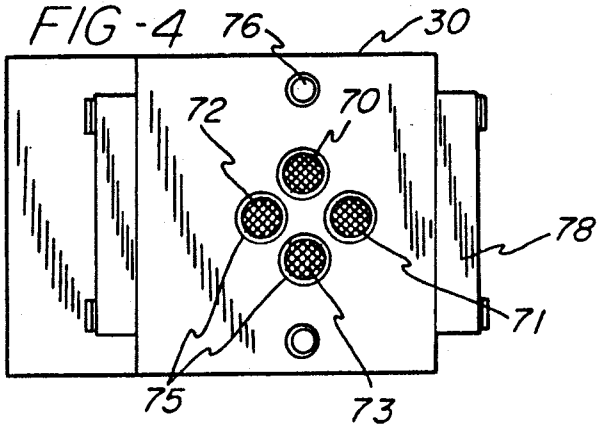
FIG. 4 is an elevational view of the bottom face of the valve body in the package shown in FIG. 3.

FIGS. 3–7 illustrate details of the mechanical construction of a valve assembly and transducer package 20 designed for use in the system shown in FIG. 2. Since the valve assembly 25 is a commercially available item, its internal construction does not require description other than that it provides the mechanical and operational characteristics already described in connection with FIG. 2, and its internal construction is such that it has on the bottom surface thereof, a pressure inlet port 70, pressure outlet ports 71 and 72, and an exhaust port 73. These ports correspond respectively to the ports 40–43 in FIG. 2, and each is shown in FIG. 4 as provided with a mesh screen. A valve member (not shown) is movable in the valve body 30 by the torque motor 33 to the operating positions described in connection with FIG. 2.

The bottom surface of the valve body 30 is provided with annular grooves surrounding each of these ports to receive an O-ring 75 for sealing the connection between each port and a corresponding port in the valve base 35 as described hereinafter. The valve body 30 is provided with drilled holes 76 to receive the bolts 36 by which the valve body and valve base are secured together. The plates 78 which are bolted to two sides of valve body 30 cover access openings to the valve member 31.

Figure 6:
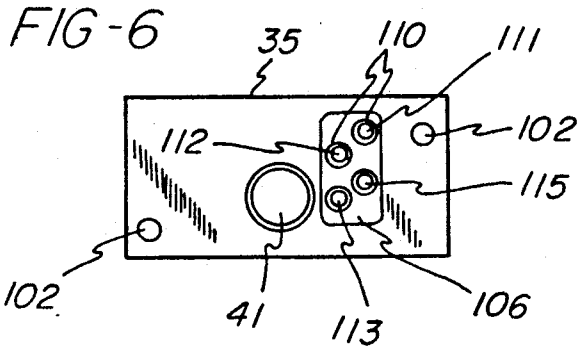
FIG. 6 is a view of the valve base looking from left to right in FIGS. 3 and 5.
Figure 5:
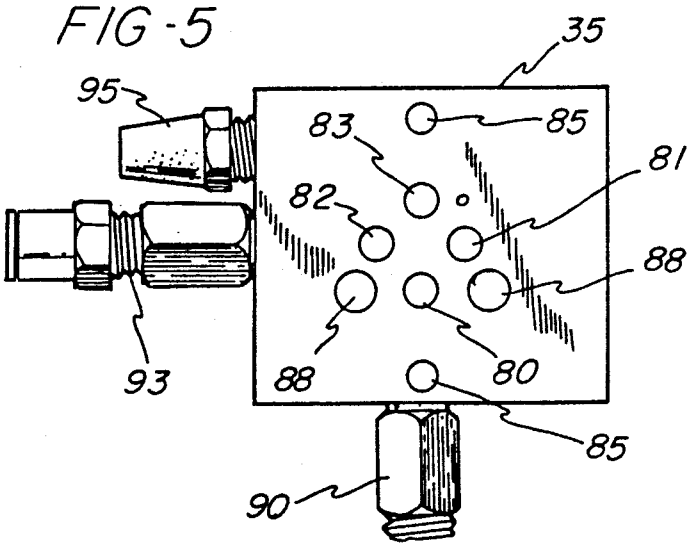
FIG. 5 is a plan view of the top of the valve base in the package shown in FIG. 3.

Referring now to FIGS. 5 and 6, the valve base 35 serves also as an adapter by means of which a commercially available valve unit is adapted for use in the package of the invention. The valve base 35 is a rectangular-sided block of metal in which multiple bore holes are drilled, and in some cases internally threaded, to provide the desired external ports and internal passages connecting therewith.

More specifically, the valve base 35 has in its upper surface four ports 80–83 that align with ports 70–73 respectively when the valve body 30 and base 35 are secured together by the bolts 36, which are received in tapped holes 85 in the upper part of valve base 35. Counterbored holes 88 extending through valve base 35 can be used to receive bolts by which the entire package is mounted on the housing of the actuator 10.

The pressure inlet port 40 is a drilled and tapped hole in one side of the valve base 35 which receives a fitting 90 on the end of the pressure line 91 from the source 22 and is connected internally of the base 35 with the port 80. The ports 41 and 42 are similar drilled and tapped holes in opposite sides of the valve base 35 to which the pressure lines 23 and 24 can be connected by fittings 93 and 94, and which are themselves connected internally of the base 35 with the ports 81 and 82 respectively.

The exhaust port 43 inside the valve body 25 is connected by an internal passage with the port 73 on the bottom of the valve body which mates with the port 83 on top of the valve base 35. Passages internally of the valve base 35 interconnect the exhaust port 83 with an external exhaust port which is shown as equipped with a powdered metal muffler 95. The plug 96 seals a hole drilled in the base 35 to complete the interconnection of passages between the exhaust ports in the valve base 35.

The transducer component of the package 20 includes a housing 100 which is rigidly mounted by bolts 101 in tapped holes 102 on the side face of the valve base which includes the pressure outlet port 41, and it is provided with gasket 104 and a through hole 103 for receiving the fitting 93 by which the pressure line 23 is connected with the port 41. A printed circuit board (not shown) of conventional construction, which includes the sensors 50 and 60 in their cases 53 and 63, is secured within the housing 100 by conventional potting compound which is molded to provide a generally rectangular boss 105 projecting beyond the surface that engages the face of the valve base 35 and proportioned to be received within a complementarily shaped recess 106 in that surface of the base 35.

At the bottom of this recess 106 there are four ports, each surrounded by an O-ring 110 to seal against the face of boss 105. The port 111 is connected internally of the valve base 35 with the pressure outlet port 41, and the ports 112 and 113 are connected internally of the valve base 35 with the pressure outlet port 42. The port 115 is similarly connected with a port in one side of valve base 35 which is open to the atmosphere and is shown as provided with a powdered metal screen 116, but which is not connected with the exhaust port 43.

Figure 7:
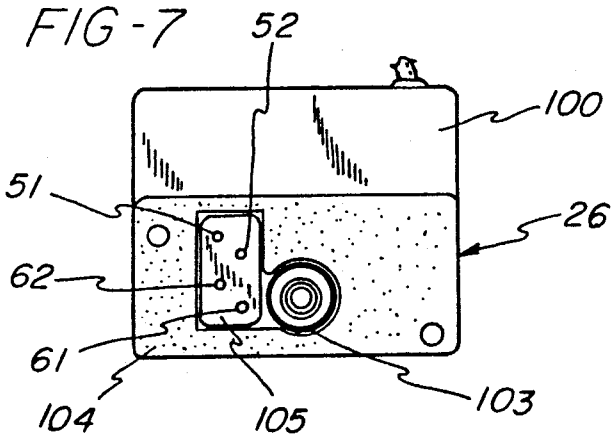
FIG. 7 is an elevational view of the pressure transducer component in FIG. 3, looking from right to left in FIG. 3.

There are four correspondingly located ports in the outer face of the boss 105 which constitute the outer ends of the pressure connections 51, 52 and 61, 62 with the sensors 50 and 60, and they are therefore similarly numbered 51, 52 and 61, 62 in FIG. 7. Thus when the housing 100 is bolted to the valve base 35, direct pressure connections will be established between the two sides of the sensor 50 and the pressure outlet ports 41 and 42, and also between each side of the sensor 60 and the pressure port 42 and the atmosphere respectively.

As already noted in connection with FIG. 2, all of the operations of the valve and transducer package 20 are under the control of the microprocessor 21, and all connections necessary for this purpose are transmitted through a multi-prong male plug 120 fixed to the outside of the transducer housing 100 and connected internally of this housing with the printed circuit board therein. The cable 121 coupled to the plug 120 contains, inter alia, lines 55 and 65. In addition, the circuits between the torque motor 33 and the microprocessor 21 pass through the plug 120 and through wires 122 connected between plug 120 and motor 33 by a swivel fitting 123 mounted on the adjacent end of the motor cover 34.

In practice, it is desirable and convenient for maximum efficiency in the practice of the invention to mount the package 20 directly on the housing of the actuator 10, which is readily done by means of bolts in the counterbored holes 88 extending through valve base 35, and with the package 120 centered lengthwise of the actuator 10 so that the pressure lines 23 and 24 will be of equal length. This arrangement assures that these pressure lines will be as short as possible, which in turn contributes to the practical objective of the invention in assuring that every measurement by the sensor 50 of the differential pressure applied by valve assembly 25 will be taken as close as practically possible to the space in which that pressure is applied in cylinder 11, and thereby correspondingly minimizing signal delays by maximizing the stability of the system as a whole.

Another contribution to accuracy provided by the invention derives from the fact that every pressure transducer has an accuracy factor associated with it, and the further fact that its accuracy decreases as the pressure being measured increases. This is important when the pressures at the opposite ends of a double acting cylinder in a pneumatic actuator are measured by separate transducers because the pressures at both ends will be approaching their maximums as the system is approaching its target position, and this is when the accuracy of pressure measurements is most critical. When separate transducers are used for the two ends of the cylinder, the normal error of each transducer will then be at or close to its maximum, and these errors will add rather than offset each other.

In contrast, using a single pressure transducer having its opposite sides exposed to the pressures in the respective opposite ends of the cylinder will result in reducing the differential pressure to a minimum, namely zero in the target position of the actuator, and this is where the accuracy of such transducers is at a maximum. This in turn means that the invention makes it practical to use a relatively inexpensive pressure transducer, which may be less accurate than more expensive varieties, while still obtaining thoroughly reliable performance characteristics because the accuracy of the transducer will be at a maximum when it is measuring in the target position of the system as a whole.

The accuracy obtained in this way also makes it possible and practical to use an inexpensive transducer 60 even though it is measuring gauge pressure in only a single pressure chamber and can therefore be expected to be subject to maximum error as the system approaches its target position. This is because the operation of the transducer 50 measuring differential pressure will provide a reference point for correction of the error of transducer 60 through the software in microprocessor 21. Thus the invention provides highly accurate measurements in each critical position of the transducer—where accuracy is most important—while using inexpensive transducers which may be individually of low accuracy.

Among other practical advantages of the package of the invention is that not only can it be connected into a closed loop operating system for a pneumatic actuator by simple coupling of electric and pneumatic lines, but it is equally simple to service, and also if either of the valve and transducer components needs replacement in the field, it can be replaced independently of the other component with equal ease. It should also be pointed out that while the valve base 35 has been described in connection with a particular commercially available valve, the same adapter can be combined with other such valves having a similarly arranged set of ports, or may be machined with its ports 80–83 differently arranged to match a correspondingly different arrangement of ports in another commercially available valve. In all such cases, the package of the invention provides the same practical and operating advantages discussed hereinabove.

While the forms of apparatus herein described constitute preferred embodiments of the invention, it should be understood that the invention is not limited to these precise form of apparatus, and that changes may be made therein without departing from the scope of the invention which is defined in the appended claims.

What is claimed is:

1. A pressure control valve and transducer package for continuously measuring and indicating the pneumatic pressure applied from the source thereof to the opposite sides of a member movable by pneumatic pressure, comprising:

(a) a four-way valve assembly including a valve body having at least one flat outer surface and having internal operating means and passages communicating with four ports on said surface consisting of a pressure inlet port, two pressure outlet ports and an exhaust port, (b) a valve base having at least one flat surface adapted to mate with said flat surface on said valve body and having in said surface four ports positioned to be aligned with said ports on said valve body, (c) means for securing said valve body and valve base together with said flat surfaces in face to face engagement interconnecting said ports, (d) means forming in and on said valve base passages an additional four ports on a second surface communicating internally of said valve base with said first named ports respectively and including an internal passage interconnecting each of said pressure outlet ports in said valve body with a pressure outlet port in an exposed surface of said valve base, (e) a housing having a face constructed for mounting in face to face mating relation on a second side of said valve base, (f) a differential pressure sensor mounted within said housing and having opposite pressure sensitive sides, (g) port means on said second face of said valve base and said mating face of said housing establishing communication between each of said pressure outlet passages in said valve base and one or the other side respectively of said sensor, and (h) means for transmitting from said sensor a signal indicating the differential pressure sensed thereby.

2. A pressure control valve and transducer package for continuously measuring and indicating the pneumatic pressure applied from a source of pressurized gas to the opposite sides of a member movable by pneumatic pressure, comprising:

(a) a valve assembly including a valve body, (b) means in said valve body defining an inlet pressure port adapted for connection with said pressure source, and first and second outlet pressure ports adapted for connection with the opposite sides respectively of said movable member, (c) valve means mounted within said valve body for movement proportionally controlling the flow of said gas from said inlet port to said outlet ports, (d) controllable means carried by said valve body for selectively moving said valve means as aforesaid, (e) means forming first and second pressure-sensing ports on one side of said valve body and separate passages within said valve body connecting said pressure sensing ports with said first and second outlet ports, respectively, (f) a housing constructed for mounting on said valve body, (g) a differential pressure sensor mounted within said housing and having opposite pressure sensitive sides, (h) means forming on one side of said housing two ports each of which communicates within said housing with one side or the other respectively of said sensor, (i) said ports in said housing being arranged for alignment with said pressure sensing ports in said valve body when said one side of said housing and said valve body are juxtaposed, (j) means for securing said housing to said valve body with said two ports therein directly connected with said pressure sensing ports in said valve body, and (k) means for transmitting from said sensor a signal indicating the differential pressure sensed thereby.

3. A pressure control valve and transducer package for continuously measuring and indicating the pneumatic pressure applied from a source thereof to the opposite sides of a member movable by pneumatic pressure, comprising:

(a) a valve assembly including a valve body and a valve base, (b) means on one face of said valve body defining an inlet pressure port adapted for connection with said pressure source, an exhaust port and first and second outlet pressure ports adapted for connection with the opposite sides respectively of said movable member, (c) valve means mounted within said valve body for movement between limit positions connecting said first or second respectively of said outlet ports with said inlet port and the other said outlet port with said exhaust port through intermediate positions disconnecting both of said outlet ports from said pressure port and from said exhaust port, (d) controllable means carried by said valve body for selectively moving said valve means between said limit positions, (e) means forming four ports on one face of said valve base arranged to mate with said ports on said valve body when said faces are in contact with each other and thereby to constitute an inlet pressure port, an exhaust port and two outlet pressure ports on said face of said valve base, (f) means for securing said valve body and valve base together with said faces thereof and said ports on said faces in mating contact, (g) said valve base having thereon a port adapted for connection to said pressure source and connected internally of said valve base with said pressure inlet port on said one face of said valve base, (h) said valve base having thereon two outlet ports adapted for connection to the respective opposite sides of said movable member and connected internally of said valve base with said two outlet pressure ports, (i) said valve base having on a second face thereof a pair of ports connected internally of said valve base with said outlet ports respectively, (j) a housing constructed for mounting on said second face of said valve base, (k) a differential pressure sensor mounted within said housing and having opposite pressure sensitive sides, (l) means on one side of said housing forming a pair of ports each of which communicates within said housing with one side or the other respectively of said sensor, (m) said pair of ports on said housing being arranged for alignment with said pair of ports on said valve base when said one side of said housing and said second face of said valve base are juxtaposed, (n) means for securing said housing to said valve base with said pairs of ports directly connected with each other to transmit to said sensor the pneumatic pressure conditions existing in said pressure outlet ports, and (o) means for transmitting from said sensor a signal indicating the differential pressure sensed thereby.

4. The transducer package defined in claim 3 wherein said controllable means (d) comprises a proportional torque motor mounted on said valve body and including a movable member operatively connected with said valve means within said valve body.

5. The package defined in claim 4 further comprising means within said housing for transmitting operating signals to said torque motor.

6. The package defined in claim 3 further comprising a second differential pressure sensor mounted within said housing and having opposite pressure sensitive sides, means on said one side of said housing forming two additional ports each of each communicates within said housing with one side or the other respectively of said second sensor, means in said valve body defining a third pressure-sensing port on said one side of said body connecting with one of said first and second outlet ports, means on said one side of said valve body forming a port connected to atmosphere separately from said exhaust port, said additional ports on said one side of said housing being arranged for alignment with said last named two ports in said valve body when said one side of said housing and said valve body are juxtaposed and secured together, and means for transmitting from said second sensor a signal indicating the pressure sensed thereby.

7. A system for controlling pneumatic pressure applied to pneumatic actuating means, comprising:

(a) pneumatic actuator means including a member having opposite sides and movable in response to pneumatic pressure applied to said opposite sides thereof, (b) a pneumatic pressure source, (c) means including a valve assembly connecting said pressure source with said actuator means, (d) means in said valve assembly defining an inlet port connected with said pressure source and first and second outlet ports connected with the opposite sides respectively of said movable member in said actuator means, (e) valve means mounted within said valve assembly for movement proportionally controlling the flow of pneumatic pressure from said inlet port to said outlet ports, (f) controllable means carried by said valve assembly for selectively moving said valve means as aforesaid, (g) means forming a pair of ports on one side of said valve assembly and separate passages within said valve assembly connecting said pair of ports with said first and second outlet ports respectively, (h) a housing constructed for mounting on said valve assembly, (i) a differential pressure sensor mounted within said housing and having opposite pressure sensitive sides, (j) means forming on one side of said housing a pair of ports each of which communicates within said housing with one side or the other respectively of said sensor, (k) said pair of ports on said housing being arranged for mating with said pair of ports on said valve assembly when said one side of said housing and said valve assembly or juxtaposed, (l) means for securing said housing to said valve assembly with said pairs of ports in directly connected relation, (m) microprocessor means for regulating movement of said valve means, and (n) means for transmitting from said sensor to said microprocessor means a signal indicating the differential pressure sensed by said sensor.

* * * * *